United States Patent [19]

Nakada et al.

[11] 4,165,685

[45] Aug. 28, 1979

[54] MECHANICAL LINK PRESS

[75] Inventors: Toshio Nakada; Naoaki Ikeoka, both of Komatsu, Japan

[73] Assignee: Kabushiki Kaisha Komatsu Seisakusho, Tokyo, Japan

[21] Appl. No.: 895,377

[22] Filed: Apr. 11, 1978

[30] Foreign Application Priority Data

Apr. 11, 1977 [JP] Japan ..... 52-44013[U]

[51] Int. Cl.[2] ..... B30B 1/06

[52] U.S. Cl. ..... 100/282; 74/44

[58] Field of Search ..... 100/282, 214; 72/450; 74/44

[56] References Cited

U.S. PATENT DOCUMENTS 2,727,573 12/1955 Ott ..... 100/282

3,315,596 4/1967 Peters ..... 100/282

FOREIGN PATENT DOCUMENTS 47-23268 6/1972 Japan ..... 100/282

*Primary Examiner*—Billy J. Wilhite

*Attorney, Agent, or Firm*—Armstrong, Nikaido, Marmelstein & Kubovcik

[57] ABSTRACT

A mechanical link press comprising a bed, a pair of side frames extending upwardly from the both ends of said bed sandwiched therebetween, a crown sandwiched by said pair of side frames at the upper ends thereof, a slide adapted to move up and down guided by said pair of side frames, a pair of main drive shafts rotatably mounted to said pair of side frames respectively, and a pair of linkages arranged within said side frames for drivingly connecting said main drive shafts with said slide, said linkages being adapted to convert the rotational motion of said main drive shafts to a linear motion of said slide.

2 Claims, 3 Drawing Figures

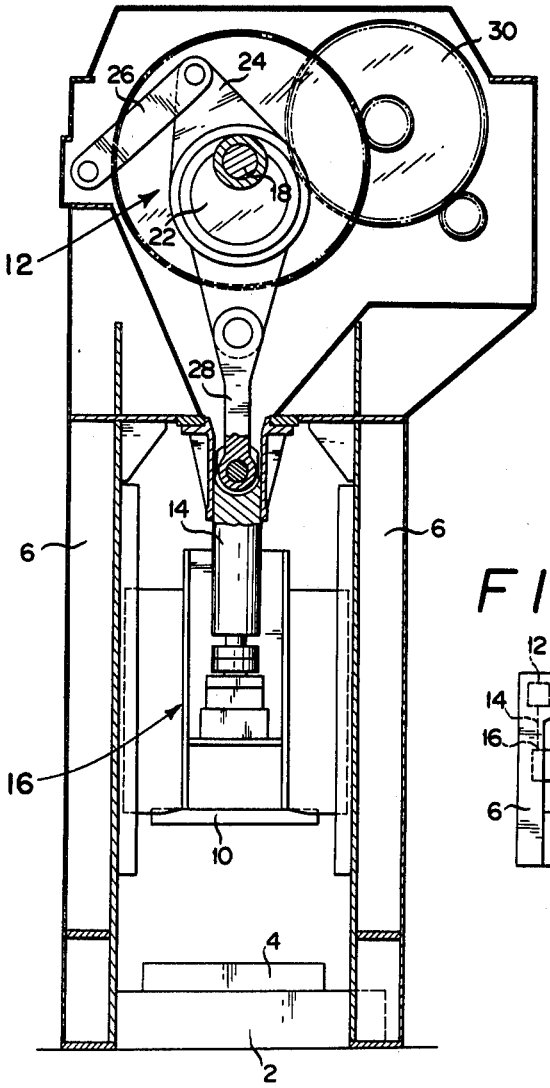
FIG. 3
FIG. 1
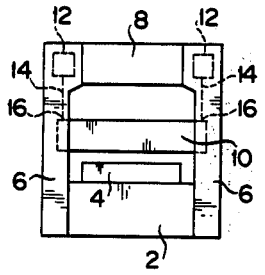

MECHANICAL LINK PRESS

BACKGROUND OF THE INVENTION

This invention relates to a mechanical link press.

Heretofore, a mechanical link press of the type specified generally comprises a bed, a pair of side frames extending upwardly from the both ends of the bed, a crown sandwiched by the pair of side frames at the upper ends thereof, and a slide adapted to move up and down between the pair of side frames guided thereby.

A pair of linkages are provided within the crown so as to convert the rotational motion of a main drive shaft to a linear motion of the slide. A pair of plungers are arranged to mechanically connect the linkages to the slide.

However, since connecting points of the slide with the pair of plungers of the above mentioned mechanical link press are positioned at relatively central part or adjacent to the central part of the slide, eccentric loads can likely to be imposed on the slide.

This is disadvantageous especially for a transfer press having a long span of the slide in its longitudinal direction.

Moreover, since the linkages are arranged within the crown, when it becomes necessary to design a new press having a different size bed and crown, the entire crown must be redesigned in order to deal with the bending moment applied thereon. Not only must the longitudinal length of the crown be changed, but the cross-sectional interworkings must also be redesigned in order to meet with the requirements of different working conditions.

SUMMARY OF THE INVENTION

It is therefore an object of the present invention to provide a mechanical link press wherein eccentric loads can hardly be imposed on a slide.

Another object of the present invention is to provide a mechanical link press designed in such a manner so that when it becomes necessary to have a press with a larger working area, the larger press may be produced by simply modifying the bed 2, the crown 8 and the bolster 4 with respect to their longitudinal length, without modifying their cross-sections.

According to an aspect of the present invention, there is provided a mechanical link press which broardly comprises a bed, a pair of side frames extending upwardly from the both ends of said bed sandwiching thereo, a crown sandwiched by said pair of side frames at the upper ends thereof, and a slide adapted to move up and down between said pair of side frames guided thereby. A pair of main drive shafts are rotatably mounted to said pair of side frames respectively, and a pair of gearings are provided each being drivingly connected to said main drive shafts respectively, said pair of gearings being mechanically connected to each other and adapted to be driven by a power source.

A pair of linkage means are arranged within said side frames for drivingly connecting said main drive shafts with said slide through a pair of plungers, said linkage means being adapted to convert the rotational motion of said main drive shafts to a linear motion of said slide.

Since the linkage means are not located within the crown as in the conventional mechanical link presses but in the side frames, when it is required to change working areas to larger ones, it is readily accomplished by simply replacing the bed and the crown with another ones having wider spans, respectively.

Further, since the connecting points of the pair of linkage means with the slide are located adjacent to the both ends of the slide, eccentric loads can hardly be imposed on the slide.

The above and other objects, features and advantages of the present invention will readily apparent from the following description taken in conjunction with the accompanying drawings.

BRIEF DESCRIPTION OF THE DRAWINGS

FIG. 1 is a schematic representation showing a rough arrangement of a mechanical link press according to the present invention;

FIG. 3 is a side elevational view in cross-section of FIG. 2.

DETAILED DESCRIPTION OF THE INVENTION

Figure 2:
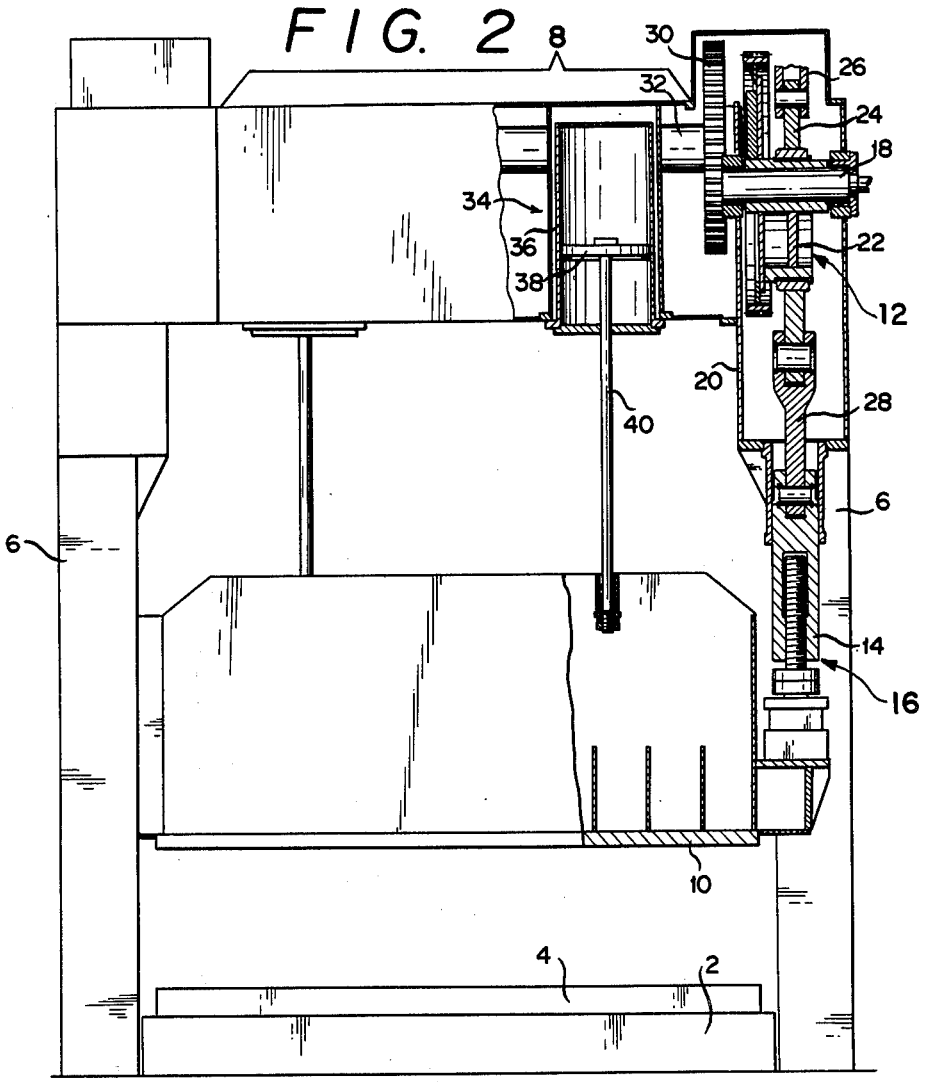
FIG. 2 is a front elevational view partially in cross-section of a mechanical link press according to the present invention.

The present invention will now be described in greater detail with reference to the accompanying drawings.

Referring to FIG. 1, reference numeral 2 denotes a bed, 4 a bolster secured thereon. A pair of side frames 6 are extended upwardly from the both ends of the bed 2 sandwiching thereof. Provided between the upper ends of the side frames 6 is a crown or top frame 8. A slide 10 is mounted between the side frames 6 and is slidably guide thereby.

A linkage mechanism 12 is arranged within each of the side frames 6 so as to convert a rotational motion into a linear motion. Plungers 14 are arranged to connect the linkage mechanism 12 with the slide 10 at connecting points 16 located adjacent to both ends thereof. Since the connecting points 16 are located adjacent to the both ends of the slide 10, eccentric loads can hardly be imposed thereon.

Further, because the linkage mechanism 12 are arranged within the side frames 6, when it is required to change working areas on the bolster 4, it is readily accomplished by simply replacing the bed 2, the crown 8 and the bolster 4 to another ones, respectively. Therefore the mechanical link press according to the present invention can be universally adopted to different working areas of the bolster 4 when required.

Referring now to FIGS. 2 and 3 which show a detailed construction of the present invention, a main drive shaft 18 is rotatably supported by side walls 20 of the each side frame 6.

An eccentric rotor or wheel 22 is fixedly mounted on each of the main drive shafts 18. A first link 24 is mounted around each of the eccentric rotors 22. A second link 26 is pivotally connected to the upper end of each of the first links 24 and the other end of the second link 26 is pivotally connected to the side walls 20 of the side frame 6.

Pivotally connected to the lower end of the each first link 24 is a third link 28. The lower end of the each third link 28 is pivotally connected to the plunger 14, which in turn is connected to the slide 10 at both ends thereof.

Each of the main drive shafts 18 is drivingly connected to a power unit (not shown) through a gearing 30.

Each gearing 30 is mechanically connected to each other by means of a connecting shaft 32.

Reference numeral 34 is a balancer which comprises an air cylinder 36, a piston 38 and a piston rod 40, lower end of which is connected to the slide 10.

It will be appreciated from the foregoing description that the most important feature of the present invention resides arranging or locating the main drive shafts 18 and the linkages 12 in the side frames 6 so as to achieve the above described objects and to enjoy the advantages of the present invention. Since, however, numerous modifications or adaptions will readily occur to the specialists in the practice of this invention, it is appropriate that the invention be construed broadly and in a manner consistant with the fair meaning or proper scope of the following claims.

What is claimed is:

1. A mechanical link press comprising a bed, a pair of side frames extending upwardly from the both ends of said bed sandwiched therebetween, a crown sandwiched by said pair of side frames at the upper ends thereof, a slide adapted to move up and down guided by said pair of side frames, a pair of main drive shaft means rotatably mounted to said pair of side frames respectively, a pair of gearings each being drivingly connected to said main drive shaft means respectively, said pair of gearings being mechanically connected to each other and adapted to be driven by a power source and a pair of linkage means arranged within said side frames for drivingly connecting said main drive shaft means with said slide, said linkage means being adapted to convert the rotational motion of said main drive shaft means to a linear motion of said slide.

2. A mechanical link press as defined in claim 1 wherein each of said linkage means comprises an eccentric rotor fixedly secured to said main drive shaft, a first link having an upper end and a lower end and being mounted at said lower end around said eccentric rotor, a second link having an upper end and a lower end and being pivotally connected to said upper end of said first link, said lower end of said second link being pivotally connected to said side frame, and a third link having an upper and a lower end and being pivotally connected to said lower end of said first link, said lower end of said third link being pivotally connected to said slide.

* * * * *